US005901632A

United States Patent [19]

Ryan

[11] Patent Number: 5,901,632

[45] Date of Patent: May 11, 1999

[54] ROPE CONSTRUCTION

[75] Inventor: Richard J. Ryan, Anacortes, Wash.

[73] Assignee: Puget Sound Rope Corporation, Anacortes, Wash.

[21] Appl. No.: 08/871,613

[22] Filed: Jun. 10, 1997

[51] Int. Cl.[6] ..... D01H 7/46; D01H 13/26

[52] U.S. Cl. ..... 87/13; 57/22; 57/287; 57/290; 57/310; 87/3; 87/8

[58] Field of Search ..... 57/22, 287, 290, 57/310, 64; 87/3, 4, 8, 13

[56] References Cited

U.S. PATENT DOCUMENTS

| | | | |
|---|---|---|---|
| 3,805,667 | 4/1974 | Orser | 87/8 |
| 4,099,750 | 7/1978 | McGrew | 87/8 |
| 4,170,921 | 10/1979 | Repass | 87/8 |
| 5,699,657 | 12/1997 | Paulson | 57/22 |
| 5,732,541 | 3/1998 | Kunzelman | 87/3 |

FOREIGN PATENT DOCUMENTS

| | | | |
|---|---|---|---|
| 2225 | of 1889 | United Kingdom | 87/8 |

*Primary Examiner*—William Stryjewski
*Attorney, Agent, or Firm*—Todd N. Hathaway

[57] ABSTRACT

A method for forming a braided rope. Twisted yarns are first braided together to form braided strands, and the braided strands are then braided together to form the rope. The diameter of the individual twisted yarns is kept to a minimum, thereby reducing the number of twisting stages required to form the yarns and also permitting heat stretching treatment using existing systems. Moreover, in-line connections can be made within the individual strands using conventional braided rope splices, which both eliminates the need to use long splices during manufacture of the rope and enables individual strands to be spliced in the field to so as to repair snags, cuts, and other service damage without having to replace an entire length of the rope.

14 Claims, 4 Drawing Sheets

ROPE CONSTRUCTION

BACKGROUND a. Field of the Invention

The present invention relates generally to the construction of ropes, and, more particularly, to a braided construction which is particularly suited to large diameter ropes made of artificial fiber materials.

b. Background

Conventional braided construction is widely used in the manufacture of ropes for various uses (it will be understood that there are also types of rope construction which are not braided, such as plain laid or cable laid ropes). In conventional braiding, twisted yarns are woven repeatedly under and over each other, so that each yarn follows a generally helical path over the full length of the rope. The angle of the path depends on the tightness of the braid, commonly expressed in terms of a number of "picks" per unit length.

The individual yarns are twisted prior to braiding primarily to form the fibers into a coherent bundle. This also serves to increase the translational efficiency of the yarns slightly (as used herein, the term "translation efficiency" expresses the relationship between the breaking strength of the yarn and the combined breaking strength of the fibers which form the yarn, in terms of a percentage of the latter value), by helping to ensure that the individual fibers are more evenly loaded. However, while a small amount of twist (e.g., ½ turn per inch for a ⅜" diameter bundle) will produce a slight increase in translational efficiency (perhaps 10%, for example), twisting the yarn further causes a rapid decline in tensile strength. This is because with further twisting the fibers on the outside of the bundle begin to follow significantly longer paths than those toward the inside, so that in use the shorter fibers may be overloaded before they can elongate sufficiently for the longer fibers to begin taking a strain; this is a particular problem when working with low-elongation fiber materials, some of which are able to stretch only about 2–4% before breaking.

Although the industry has for many years made braided ropes using twisted yarns, this technique has exhibited several serious drawbacks in connection with certain recent advances. For example, there is an increasing need for very large diameter braided ropes (e.g., for use on large escort tugboats, in single point mooring systems, in the offshore oil industry, etc.), but because of existing equipment and other reasons most braided rope is limited to using a certain number of strands (e.g., 12-strand braided rope, 8-strand braided rope, etc.). Consequently, when making larger diameter ropes the conventional practice has been to simply increase the diameter of the yarns.

The approach of simply "scaling up" the system has not proven successful, however, especially when using comparatively new, low-elongation fiber materials, such as polyester, Kevlar™, and UHMWPE (ultra-high molecular weight polyethylene) materials such as Spectra™, for example. This is in part because the formation of large diameter yarns requires multiple stage twisting when working with synthetic fiber materials (because of their rough surface texture natural fibers tend to form a firm bundle upon initial twisting, but synthetic fibers are much smoother and slippier). As was noted above, the degree of twist which is necessary to achieve optimal translational efficiency is typically very small, regardless of the fiber material, and overtwisting is very detrimental to tensile strength. When performing multiple-stage twisting, however, it is virtually impossible to give the yarn a satisfactory level of coherency without exceeding the optimal amount of twist, with the result that translational efficiency suffers severely. On the other hand, while it is possible to use a very loose twist so as to avoid a loss of translational efficiency, this results is an unacceptably low level of coherency and produces a loose, "sleazy" yarn which is prone to snag damage and is otherwise unsuitable for commercial service. In short, when using large-diameter twisted yarns, it is difficult or impossible to achieve an acceptable degree of coherency along with a high level of translation efficiency.

Processes exist by which twisted UHMWPE and other yarns can be successfully stretched at elevated temperatures to achieve a high degree of translational efficiency without damaging the individual fibers. Even these processes have a practical upper limit in terms of the diameter of yarn which can be successfully treated in a production operation, however, and for the present this limit is well below the diameter of the yarns which are required for the construction of very large braided ropes using conventional manufacturing techniques.

Another problem stems from the need to splice the yarns multiple times when braiding long pieces of rope. To illustrate this, reference is made to FIG. 5, which shows a conventional braider machine 01 having a plurality of bobbins 02 mounted on a table 03 for developing an intertwining rotation (note: since the braider machine does not itself constitute a part of the present invention and is well known to those skilled in the relevant art, only an overview of the mechanism will be provided here). As the bobbins move about, the yarns are woven over and under one another and drawn upwardly through a collar 05 by a take-up reel 07. Then, as each bobbin runs out of yarn, it is necessary to stop the machine and splice in the yarn from a fresh bobbin. It is not generally practical to splice the ends of twisted yarns together (since they tend to simply unravel into an incoherent mass), and so the conventional practice has been to place the fresh bobbin in an open area 08 at the center of the table and then lead the end of the yarn upwardly into the core of the rope, as indicated by arrow 09. The machine is run to form another 20–30 feet (typically) of rope, and then the yarn from the old bobbin is cut off and the new bobbin is mounted in its place at the edge of the table.

This technique is conventionally referred to as a "braider interchange," and although used for many years it is unsatisfactory in many respects. Firstly, because this is a frictional splice it will always represent a weak spot in the rope. Also, the 20–30 ft overlap represents a costly wastage of material, especially when using expensive fibers. Still further, this type of splice becomes extremely difficult to perform when braiding large diameter ropes. This is because the spools which are needed to carry the larger-diameter twisted yarns are much bigger and more tightly packed on the table of the braider machine than is shown in FIG. 5, with the result that there is simply no space in the middle of the table in which to position the replacement spool (scaling up the size of the machines to provide more room is too expensive to be a practical option). Moreover, when the twisted yarns are very large it becomes difficult to handle the heavy, stiff end of the yarn and feed it up into the core of the rope.

The use of large twisted yarns to form the strands of the rope also makes it very difficult to make repairs to conventional braided ropes when individual strands become damaged in service. For example, a single yarn may become snagged, cut, or otherwise damaged while the remainder of the rope remains intact. The inability to repair the individual yarns, however, means that an entire length of the rope must be discarded, at great cost.

Accordingly, there exists a need for a method of constructing large diameter braided ropes wherein a high degree of translational efficiency is achieved, especially when using low-elongation fiber materials. Furthermore, there exists a need for such a method of construction which allows large-diameter braided rope to be manufactured without having to use excessively large twisted yarns. Still further, there exists a need for such a method of construction which permits faster, more efficient splices to be formed between the ends of individual strands during the construction of the rope. Still further, there is a need for such a method for constructing braided ropes which permits individual strands to be spliced so as to repair damage without having to discard an entire length of the rope.

SUMMARY OF THE INVENTION

The present invention has solved the problems cited above, and provides a method of constructing braided rope. Broadly, this comprises the steps of (a) twisting a multiplicity of fibers together so as to form a plurality of twisted yarns; (b) braiding a plurality of the twisted yarns together so as to form a plurality of braided strands; and (c) braiding a plurality of the braided strands together so as to form the braided rope.

The method of the present invention may further comprise the step of heat stretching the twisted yarns prior to the step of braiding these together to form the braided strands. Low-elongation UHMWPE fiber material may be used to form the strands, and the twisted yarns may be braided together to form the strands without any further twisting of the yarns occurring after the heat stretching step.

The method may also include the steps of (a) mounting a plurality of bobbins carrying the braided strands on a braider machine, (b) operating the braider machine so that the braided strands are paid out from the bobbins and woven together to form the braided rope, and (c) forming in-line connections between first and second segments of the strands using braided rope splices, so that the segments form continuous strands in the rope. The step of forming the connection between the first and second segments of the braided strands may comprise the steps of: (a) stopping operation of the braider machine when a first bobbin on the machine is reaching an end of the first segment of braided strand which is carried thereon; (b) splicing a tail end of the first segment of braided strand to a lead end of the second segment of braided strand which is carried on a second bobbin, using a braided rope splice; (c) replacing the first bobbin on the braider machine with the second bobbin; and (d) resuming operation of the braider machine after the first bobbin has been replaced by the second.

The present invention also provides a braided rope which comprises (a) a multiplicity of fibers twisted together so as to form a plurality of twisted yarns; (b) a plurality of the twisted yarns being braided together so as to form a plurality of braided strands; and (c) a plurality of the braided strands being braided together so as to form the braided rope.

At least one strand in the rope may comprise an in-line splice formed between first and second segments of the braided strand using a braided rope splice, so that these segments form a continuous strand within the rope.

The braided rope may be a comparatively large-diameter twelve-strand rope having a diameter of about 3" or greater, in which the twisted fiber yarns comprise twisted fiber yarns having a comparatively small diameter so that no one of these has a cross-sectional area greater than about 1/144th of the total cross-sectional area of the rope, so as to minimize the number of stages of twisting which are required to form each of the yarns in the rope.

DETAILED DESCRIPTION

The present invention provides a form of rope construction which is especially suited to the manufacture of large-diameter braided rope in comparatively long lengths. Moreover, the form of construction provided by the present invention is in many respects particularly advantageous for use with very low-elongation fibers such as UHMWPE fiber materials. It will be understood, however, that many of the advantages of the present invention are applicable to the construction of large braided ropes regardless of their length or the type of fiber material which is used.

In the present invention, the large-diameter braided rope is formed by the braiding of strands which themselves have been braided, as opposed to using large-diameter twisted yarns as is done in conventional practice. The present invention thus allows the rope to use twisted yarns having a much smaller diameter than would otherwise be required, which in turn reduces or eliminates the need for multiple-stage twisting of the yarns. Moreover, for even very large sizes of rope this permits the use of yarn bundles having sufficiently small diameters that they can be treated using known heat stretch processes to achieve a high degree of translational efficiency. Still further, by making use of braided strands to construct the large-diameter braided rope, the present invention enables the ends of individual strands to be connected using strong, quick braided rope splices, in place of the wasteful and inefficient braider interchange described above, and also makes it possible to repair individual strands which become damaged in use.

Figure 1:
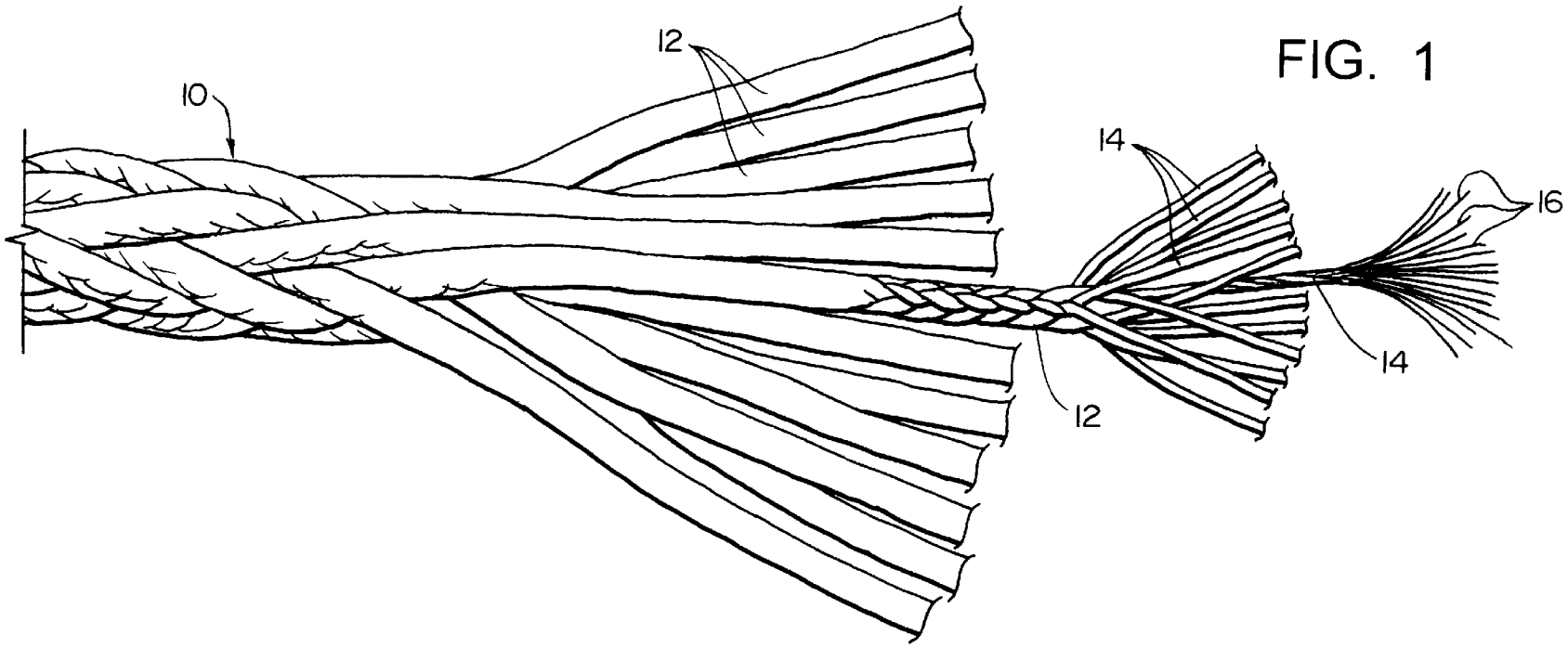
FIG. 1 is an elevational view of an end portion of a braided rope constructed in accordance with the present invention, showing schematically the manner in which small-diameter twisted yarns are braided together to form braided strands which are then braided together to form the rope itself.
Figure 2:
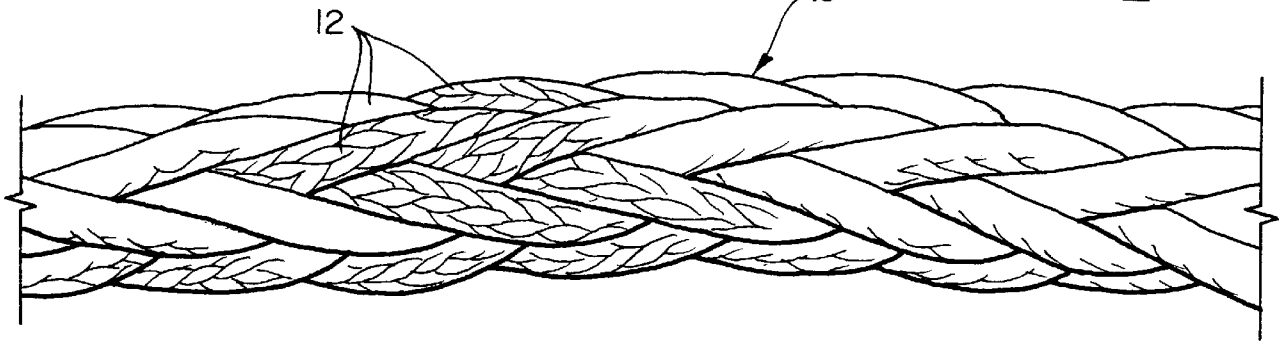
FIG. 2 is an elevational view of a length of the braided rope of FIG. 1.
Figure 3:
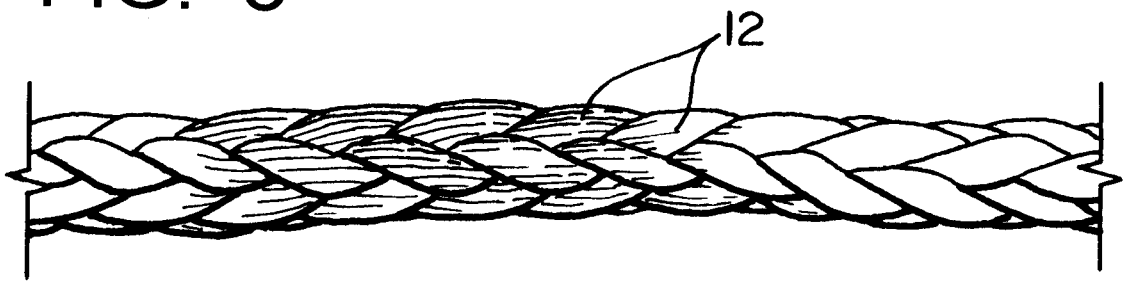
FIG. 3 is an elevational view of a single one of the braided strands which are braided together to form the rope of FIG. 2.

Accordingly, FIG. 1 shows a large-diameter braided rope 10 which is constructed of a plurality of individual strands 12, each of which itself is a braided member. The particular embodiment which is illustrated employs a 12-strand, two-over/two-under form of braid, but it will be understood that the present invention may be used with other forms of braid and other numbers of strands (such as 8-strand construction, for example). Hence, in the illustrated embodiment, twelve of the braided strands are woven together to form the body of the rope. Each of the braided strands, in turn, is woven from twelve twisted yarns 14 (although, again, the actual number may vary as a matter of design choice), each of which in turn is formed of a multiplicity of individual fibers 16 which have been twisted together to form a coherent bundle. The result, as can be seen in FIG. 2, is a braided rope 10 in which each of the strands 12 is itself similar in form to a braided rope.

Figure 5:
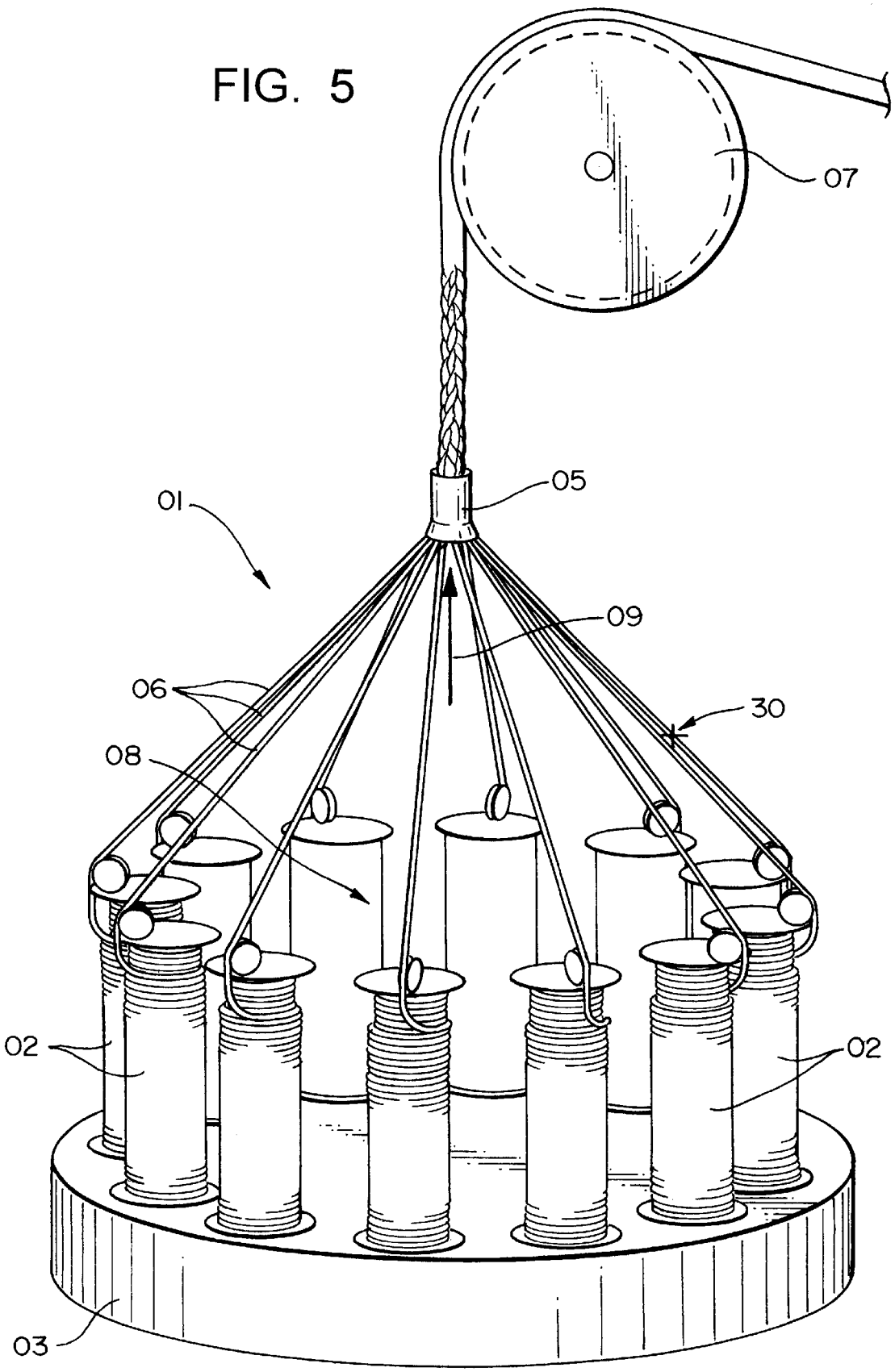
FIG. 5 is a perspective view of an exemplary braider machine for use in constructing braided rope in accordance with the method of the present invention.

Hence, to construct the rope 10, the individual twisted yarns 14 are first twisted from the fibers 16 and then braided together using a braider machine, such the twelve-strand braider shown in FIG. 5. The braided strands 12 which this produces are then wound onto second spools and loaded onto another braider machine, by which they are woven together to form the finished rope.

Figure 4:
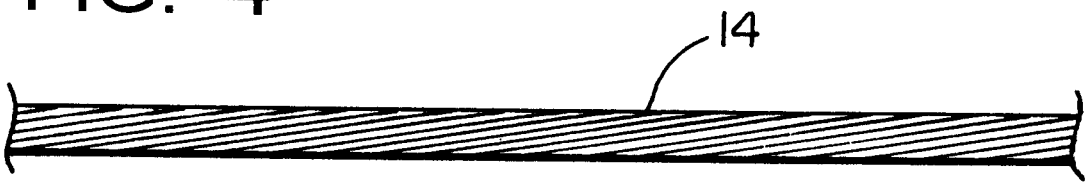
FIG. 4 is an elevational view of an individual one of the comparatively small-diameter twisted yarns which are braided together to form the braided yarns as shown in FIG. 3.
Figure 4A:
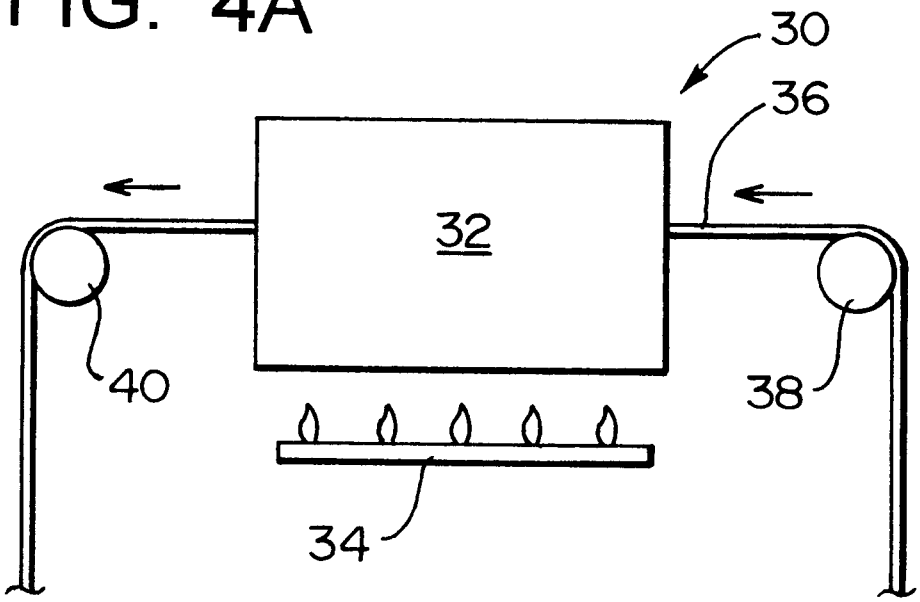
FIG. 4A is a somewhat schematic view of a heat stretching assembly suitable for stretching small-diameter twisted yarns.

As was noted above, because the yarns 14 are first braided into the strands 12 before being woven into the rope itself, these will have a diameter which is only a fraction of that which would be required if the twisted yarns were to be woven directly into the main rope, as has been done in the past. For example, for a twelve-strand rope constructed of twelve-yarn strands as shown in FIG. 1, each of the twisted yarns will have a cross-sectional area of only about 1/144th the total cross-sectional area of the rope. As a result, even for a large diameter (e.g., 3-inch) braided rope, the diameter of the individual yarns is kept down to a size (e.g., 3/8 inch) at which they can be effectively treated by means of the heat stretch processes noted above so as to achieve very high translational efficiencies. For purposes of illustration, FIG. 4A shows an exemplary apparatus 30 for heat stretching yarns for use in such ropes. As can be seen, this includes a chamber 32 which is maintained at an elevated temperature by a heat source 34, and through which the yarn 36 is fed by feed and takeup rollers 38, 40. The temperature in the chamber is typically somewhat below the melting point of the fiber material, and the yarn is stretched out by maintaining tension between the feed and takeup rollers. FIG. 4A shows an apparatus which is constructed for heat stretching of the yarn on a continuous basis, however, it will be understood that the apparatus itself is not a part of the present invention, and that various other devices for heat stretching yarns on a continuous or batch basis are know to those skilled in the art. Also, because the present invention permits the small diameter yarns to be woven into the rope without any further twisting, the high degree of translational efficiency is retained in the finished product.

Moreover, because the braiding process itself imparts a very limited amount of additional twist to the strands, the present invention makes it possible (unlike the prior art multiple-stage twisting described above) to maintain an optimal degree of twist in the yarns so as to achieve maximum translational efficiency in the finished rope. For example, in accordance with the present invention, the yarns can simply be given the optimal degree of twist initially, and this twist will remain largely unaffected by the subsequent braiding steps. Moreover, in some cases the yarns may be given an initial degree of twist which is just slightly less than optimum, to compensate for a small but predetermined amount of twist which will be added during the braiding process, so that the optimal degree of twist will be more closely approximated in the final product. Conversely, the tightness of the braid (i.e., the number of picks per unit length) can be adjusted as necessary to add a small but known amount of twist as desired.

As a result, braided ropes constructed in accordance with the present invention are able to achieve a significantly higher tensile strength than is possible with a twisted strand rope constructed to have the same body and coherence. For example, a 10-inch circumference UHMWPE fiber rope constructed in accordance with the present invention was found in testing to have a breaking strength of approximately 1.1 million pounds, whereas a twisted strand braided rope constructed of the same material to have a comparable level of coherency has at best a breaking strength of approximately 900,000 pounds. Hence, in this example, the present invention provides a better than 20% improvement in tensile strength while using the same type and amount of fiber material.

Figure 6A:
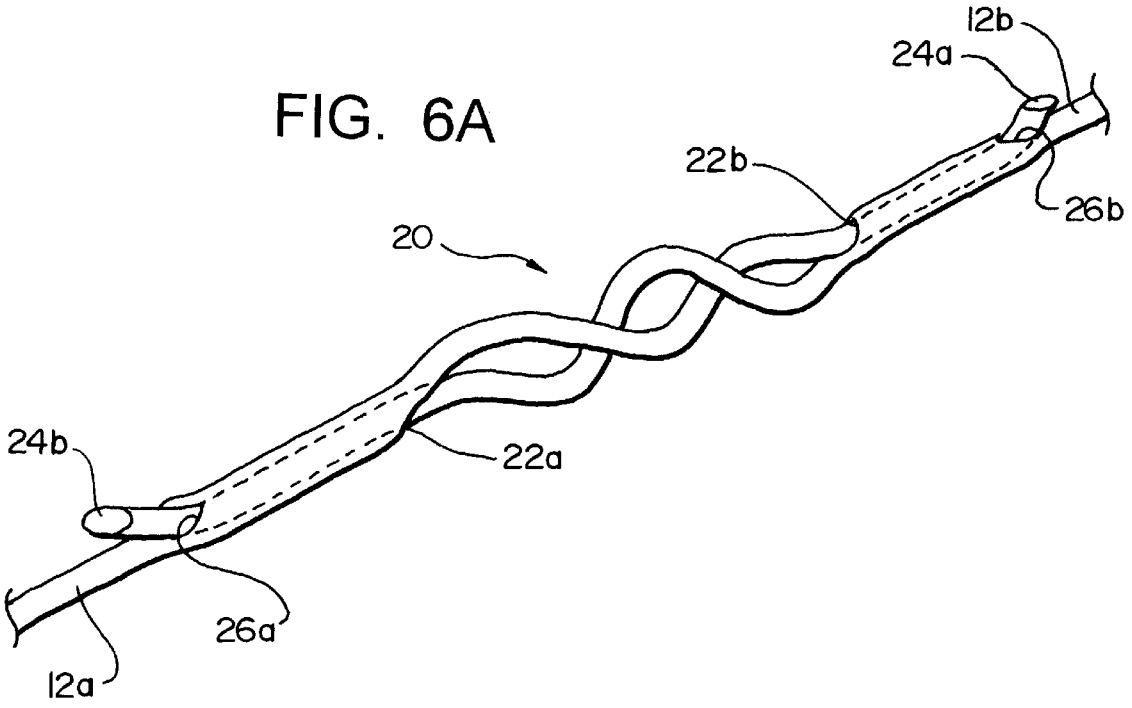
FIG. 6A is a perspective view of the manner in which an exemplary type or braided rope splice can be used to connect the individual braided strands in a rope constructed in accordance with the present invention, either during the initial manufacture thereof or to repair damage suffered in use.
Figure 6B:
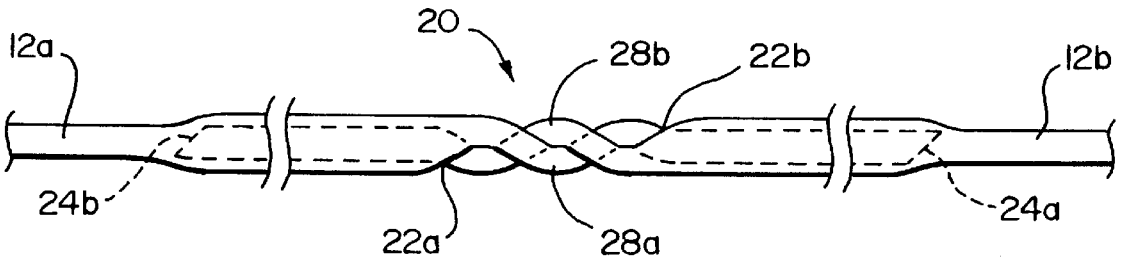
FIG. 6B is an elevational view showing the completed splice of FIG. 6A.

As was also noted above, another important advantage of the present invention is that the braided structure of the strands 12 permit these to be spliced "in-line" on an individual basis by means of a quick, efficient, and very strong braided rope splice. As is used in this specification and the appended claims, the term "braided rope splice" includes all of those various types of splices which are known to those skilled in the relevant art for connecting two segments of braided rope in a more or less end-to-end relationship (as opposed to eye splices, for example). For example, FIGS. 6A–6B show first and second braided yarns 12 which are joined by means of a Chinese finger splice 20, which is one form of braided rope splice. This particular type of splice is made by spreading the braid apart using a fid or similar tool, to form openings 22*a*, 22*b* through which the overlapping ends 24*a*, 24*b* of the members are passed. Each end piece is drawn a short distance through the core of the other member, and then out through exit openings 26*a*, 26*b* which are also formed by spreading apart the braid. The two members 12*a*, 12*b* are pulled taught to tighten the intertwined middle segments 28*a*, 28 and then milked to draw the cut ends 24*a*, 24*b* back into the core, thereby completing the splice as shown in FIG. 6B. Not only is this type of splice quick and easy to make, it is extremely strong and requires little overlap (e.g., 3–4') between the two members and therefore wastes little material.

The ability to thus splice the individual strands makes it possible to eliminate the braider interchange technique which has previously been used in the manufacture of braided rope. When using braided strands in accordance with the present invention, when a bobbin is about to run empty the braider machine can simply be stopped momentarily, the end of the strand on the old bobbin can be spliced (e.g., at the point indicated at 30 in FIG. 5) to that on a fresh one, and then the new bobbin can be placed in position and the machine restarted. In addition to eliminating the weak and wasteful traditional braider interchange, the strand splice used in the present invention is also much easier and faster to perform, and obviates the problem of trying to fit the bobbin into the middle of the braider table when using large-diameter strands.

Moreover, the ability to splice the individual braided yarns permits cuts, frays, and other damage which occurs in service to be repaired using readily available tools and skills. The capability to thus repair multi-thousand dollar ropes which would otherwise have to be discarded represents a tremendous savings to the customers.

Yet another advantage of the present invention is that this allows the finished rope to be constructed with a much looser final braid (i.e., a lower of number of picks per length) than would be possible using only twisted yarns, which is advantageous for certain applications and types of rope. When using twisted yarns, a very loose braid can result in the yarns bunching and spreading apart, exposing the individual fibers to abrasion and damage. With the present invention, however, the first braid (i.e., the initial braiding of the yarns)

can be made sufficiently tight to form strands which are durable and coherent, and then the final braid can be as loose as desired without impairing the serviceability of the rope.

Although the present invention has been described herein with reference to an exemplary embodiment in which there are two braiding steps, it will be understood that in some embodiments there may be additional braiding steps, depending on the ultimate size of the rope, the type of material used, and other design considerations; for example, in some embodiments the small-diameter yarns may be braided together to form primary strands, which are then braided into secondary strands before being braided together to form the rope. It is therefore to be recognized that these and various other alterations, modifications, and/or additions may be introduced into the constructions and arrangements of parts described above without departing from the spirit or ambit of the present invention as defined by the appended claims.

What is claimed is:

1. A method of constructing a braided rope, said method comprising the steps of:

twisting a multiplicity of fibers together so as to form a plurality of twisted yarns;

heat stretching said twisted yarns;

braiding a plurality of said twisted yarns together after heat stretching so as to form a plurality of braided strands; and braiding a plurality of said braided strands together so as to form said braided rope.

2. The method of claim 1, wherein the step of braiding said plurality of twisted yarns together comprises:

braiding said twisted yarns together to form said braided strands without further twisting of said yarns after said heat stretching thereof.

3. The method of claim 1, wherein the step of twisting a multiplicity of fibers together comprises:

forming said multiplicity of fibers of a low-elongation UHMWPE fiber material.

4. The method of claim 3, wherein the step of heat stretching said twisted yarn comprises:

heat stretching said twisted yarns formed of fibers of said low-elongation UHMWPE fiber material at an elevated temperature and pressure.

5. The method of claim 4, wherein the step of braiding said plurality of twisted yarns together comprises:

braiding said twisted yarns together to form said braided strands without further twisting of said yarns after said heat stretching thereof.

6. The method of claim 1, wherein the step of braiding said braided strands together to form said braided rope comprises:

loading said plurality of strands which have been braided together onto a plurality of bobbins;

mounting said plurality of bobbins on a braider machine; and operating said braider machine so that said braided strands are paid out from said bobbins and braided together so as to form said braided rope.

7. The method of claim 6, wherein the step of braiding said braided strands together to form said braided rope further comprises:

forming an in-line connection between a tail end of a first braided strand and a lead end of a second braided strand using a braided rope splice, so that said first and second strands form a continuous one of said strands of which said rope is formed.

8. The method of claim 6, wherein the step of forming said in-line connection between first and second braided strands comprises:

loading said first braided strand on a first said bobbin on said braider machine;

stopping operation of said braider machine when said first braided strand on said first bobbin is reaching said tail end thereof;

splicing said tail end of said first braided strand on said first bobbin to said lead end of said second braided strand which is carried on a second bobbin, using a braided rope splice;

replacing said first bobbin on said braider machine with said second bobbin; and resuming operation of said braider machine after said first bobbin has been replaced by said second bobbin.

9. The method of claim 1, wherein said braided rope is a 12-strand rope having a diameter of about 3 inches or greater, and the step of twisting said fibers together so as to form said twisted yarns comprises:

twisting said fibers together so as to form said twisted fiber yarns with a comparatively small diameter so that no one of said yarns has a cross-sectional area greater than about 1/144th of a total cross-sectional area of said rope, so as to minimize the number of stages of twisting which are required to form each of said yarns used in said large-diameter rope.

10. A braided rope, comprising:

a multiplicity of fibers twisted together so as to form a plurality of twisted yarns;

a plurality of said twisted yarns being braided together so as to form a plurality of braided strands, each said twisted yarn having been heat stretched prior to being braided together to form said braided strands; and a plurality of said braided strands being braided together so as to form said braided rope.

11. The braided rope of claim 10, wherein said multiplicity of fibers comprise:

a multiplicity of fibers formed of a low-elongation UHMWPE fiber material.

12. The braided rope of claim 11, wherein each said braided strand comprises:

a plurality of said twisted yarns which have been braided together to form said braided strand without further twisting of said yarns after heat stretching thereof.

13. The braided rope of claim 10, further comprising:

at least one in-line splice formed between a tail end of a first braided strand and a lead end of a second braided strand using a braided rope splice, so that said first and second strands form a continuous one of said braided strands of which said rope is formed.

14. The braided rope of claim 10, wherein said braided rope is a comparatively large-diameter 12-strand rope having a diameter of about 3 inches or greater, and wherein said twisted fiber yarns comprise:

twisted fiber yarns having a comparatively small diameter so that no one of said yarns has a cross-sectional area greater than about 1/144th of a total cross-sectional area of said rope, so as to minimize the number of stages of twisting which are required to form each of said yarns which is used in said large-diameter rope.

* * * * *